US007175316B2

(12) United States Patent
Shpizel

(10) Patent No.: US 7,175,316 B2
(45) **Date of Patent: *Feb. 13, 2007**

(54) SEARCHLIGHT WITH IMPROVED OPTICAL DENSITY

(75) Inventor: Matvey B. Shpizel, Brooklyn, NY (US)

(73) Assignee: Hyperboloid Corporation, Wurtsboro, NY (US)

( * ) Notice: Subject to any disclaimer, the term of this patent is extended or adjusted under 35 U.S.C. 154(b) by 138 days.

This patent is subject to a terminal disclaimer.

(21) Appl. No.: 10/626,481

(22) Filed: Jul. 24, 2003

(65) Prior Publication Data

US 2004/0246724 A1 Dec. 9, 2004

Related U.S. Application Data

(63) Continuation of application No. 10/029,453, filed on Dec. 20, 2001, now Pat. No. 6,604,843.

(30) Foreign Application Priority Data

Dec. 20, 2000 (RU) ..... 2000133024

(51) Int. Cl.
*F21V 5/00* (2006.01)
*F21V 13/04* (2006.01)

(52) U.S. Cl. ..... 362/328; 362/299; 362/268; 362/308; 362/331

(58) Field of Classification Search ..... 362/299, 362/296, 302, 304, 308, 327, 328, 331, 520, 362/521, 538, 268, 300
See application file for complete search history.

(56) References Cited

U.S. PATENT DOCUMENTS 1,427,505 A * 8/1922 Whyte ..... 362/299
4,739,456 A * 4/1988 Little ..... 362/268
6,604,843 B2 * 8/2003 Shpizel ..... 362/299

* cited by examiner

*Primary Examiner*—Sandra O'Shea
*Assistant Examiner*—Guiyoung Lee
(74) *Attorney, Agent, or Firm*—Marsh Fischmann & Breyfogle LLP

(57) ABSTRACT

This invention relates to searchlight type light devices including underwater light devices and automobile headlights. A light device in accordance with the present invention provides light beam compression along the optical axis and thus increases considerably the intensity or optical density of the beam. The light device includes a light source, a main concave reflector, and a lens projection system, the main concave reflector and the lens projection system being aligned relative to the optical axis and the light source being located between the reflector and the lens projection system, on the same optical axis. In addition, the main collecting pre-reflector lens is mounted between the light source and the main reflector, the main reflectors concave surface being implemented as a segment of sphere, and the light source being located in the focal point of such main reflector. Said main collecting pre-reflector lens has a focal length exceeding the main reflector's focal length by a factor of 1.25–2.0, its diameter is equal to or exceeds the main reflector diameter, and this lens is located at a distance from the main reflector which does not exceed half of the distance from the main reflector to the light source.

28 Claims, 1 Drawing Sheet

SEARCHLIGHT WITH IMPROVED OPTICAL DENSITY

RELATED APPLICATIONS

This patent application is a Continuation of application Ser. No. 10/029,453, filed Dec. 20, 2001, now U.S. Pat. No. 6,604,843.

FIELD OF THE INVENTION

This invention relates in general to searchlight type light devices including underwater light devices and automobile headlights and the like and, in particular, to a searchlight type light device including an optical collector interposed between a source and a reflector for improved beam optical density.

BACKGROUND OF THE INVENTION

Search lights are used in a number of applications including vehicle headlights, underwater lights, search lights for emergency vehicles such as police cars, helicopters, etc., and the like. In many of these applications, it is desired to provide a narrow beam of light. A narrow beam of light may be desired to provide more effective illumination at large distances, greater intensity for a given light source at a given distance and to reduce the intensity of stray light outside of the desired area of illumination that may, for example, annoy oncoming motorists or pose a safety risk.

Search lights typically include a light source, a reflector behind the light source and a lens in front of the light source. The reflector and lens are intended to act in concert to collect light from the source and collimate or focus the light into a desired beam. Much development work has been directed to the design of the reflector and lens so as to produce a narrow beam and significant advances have been made in this regard.

One known light device is described in Russian patent application no. RF 98109712 "Headlight for Automobiles" (priority dated 19 May 1999 and published 27 Feb. 2000). That device includes a reflector, a refractor, and a light source. The reflector has a base surface of spherical, parabolic, elliptical or hyperbolic type and is equipped with convex or concave basic reflecting elements whose working surface is shaped as a Bezier surface or looks like a circle or an ellipse in the vertical and horizontal cross-sections. In addition, the basic reflecting elements are equipped with concentrating reflecting elements whose vertical dimension is less than or equal to that of the basic reflecting elements, and the horizontal dimension is less than or equal to that of the basic reflecting elements.

Another known light device is described in Russian patent no. RF 2115060 "Headlight for Transport Vehicles" (priority dated 16 Dec. 1993 and published 10 Jul. 1998). That headlight is a projection type headlight and includes a reflector, a light source, a screen and a lens. The reflector is a concave surface shaped as a paraboloid, the light source is located inside this reflector, and the lens is located so that its optical axis coincides with the reflector's optical axis, and its focal point coincides with the focal point of the same reflector.

A further known device is described in Russian patent no. RF 2149307 "Light Device" (priority dated 1 Dec. 1998 and published 20 May 2000. That device includes a light source, an ellipsoidal reflector, a lens projection system optically aligned with the ellipsoidal reflector, and a reflector-diaphragm located between the ellipsoidal reflector and the projection system. The light source is located in the ellipsoidal reflectors geometrical center, and the ellipsoidal reflector proper and the lens projection system are so arranged relative to each other that their focal points coincide.

Devices such as described in these patents typically have limited luminous flux intensity or optical density in the transmitted beam, e.g., because the direct association of the source with the reflector provides a beam diameter at least as great as that of the reflector, because the lens projection system provides a collimated or diverging beam or because the devices otherwise generally provide a beam that is not compressed along its axis.

SUMMARY OF THE INVENTION

An important advantage of this invention is the provision of a light device where the light beam is minimally divergent or compressed along the optical axis, thereby allowing for increased intensity over an illumination range of interest. In accordance with one aspect of the invention, the light device includes a light source, a main concave reflector, and a lens projection system, the main concave reflector and the lens projection system being aligned, and the light source being located between the reflector and the lens projection system and on the same optical axis. The device includes a main collecting pre-reflector tens mounted between the light source and the main reflector. Preferably, the main reflector's concave surface is implemented as a segment of sphere, and the light source is located in the focal point of this main reflector. The main collecting pre-reflector lens preferably has a focal length exceeding the main reflectors focal distance by a factor of 1.25–2.0, its diameter is preferably equal to or exceeds the main reflector's diameter, and this lens is preferably located at a distance from the main reflector which does not exceed half of the distance from the main reflector to the light source.

According to another aspect of the invention, a collecting pre-reflector lens is so mounted in the light device that it can be displaced along its optical axis, which facilitates a precise optical adjustment of the entire device resulting in a denser and narrower optical beam.

In accordance with a further aspect of the invention, a diaphragm can be mounted before the lens projection system in the light device, thus reducing the level of the transmitted radiation component that has not been compressed in a narrow light beam by the device.

According to a still further aspect of the present invention, an auxiliary concave reflector and a second collecting pre-reflector lens can be provided in the light device. In that case, the dimensions and shape of the auxiliary reflector are preferably similar to those of the main concave reflector, but a through hole is cut in the wall of the auxiliary reflector, no less in diameter than half of the point light source diameter, but no bigger than two diameters of such point light source, the axis of this through hole coinciding with the auxiliary reflector's optical axis. All characteristics of the second collecting pre-reflector lens are preferably similar to the characteristics of the main collecting pre-reflector lens. The auxiliary concave reflector and the other collecting pre-reflector lens are preferably located opposite to the light source relative to the main concave reflector and the main biconvex lens, symmetrically with them, and so that the optical axes of the auxiliary concave reflector and the other collecting pre-reflector lens coincide with the optical axis of the main concave reflector. The auxiliary concave reflector can be mounted at such a distance from the main concave reflector that the focal points of both reflectors will coincide.

An important aspect of the present invention relates to the use of a focusing or some other lens mounted between the light source and the reflector. Such a lens collects the radiation coming from the light source in a light spot of small diameter on the reflector. The reflector additionally focuses the radiation collected in the light spot in an even narrower light spot on the collecting lens. The luminous radiation passing from the light spot through the lens mounted before the reflector is collected in the focal point of the lens. Since the luminous radiation passing through the pre-reflector lens comes from a light spot of small diameter, the divergence of the radiation focused by this pre-reflector lens is low. Therefore, when this radiation reaches the lens projection system mounted behind the light source, the lens projection system shapes this radiation as a minimum-divergence or compressed narrow light beam. In addition, this narrow light beam is formed of the radiation focused on the reflector, and so its intensity is high: output measurements have shown that its intensity is at least twice as great as the intensity of the radiation produced by certain known devices. Even taking into consideration the fact that a pre-reflector lens mounted between the light source and the reflector causes radiation losses because of its reflection from the surface of that lens, radiation intensity proves to be at least twice as great in the beam formed using the inventive device as when the light beam is obtained using certain known light devices. The reason is that the effect caused by the pre-reflector lens' focusing action proves to be greater than the effect caused by radiation reflection on the surface of this lens.

DETAILED DESCRIPTION

Figure 1:
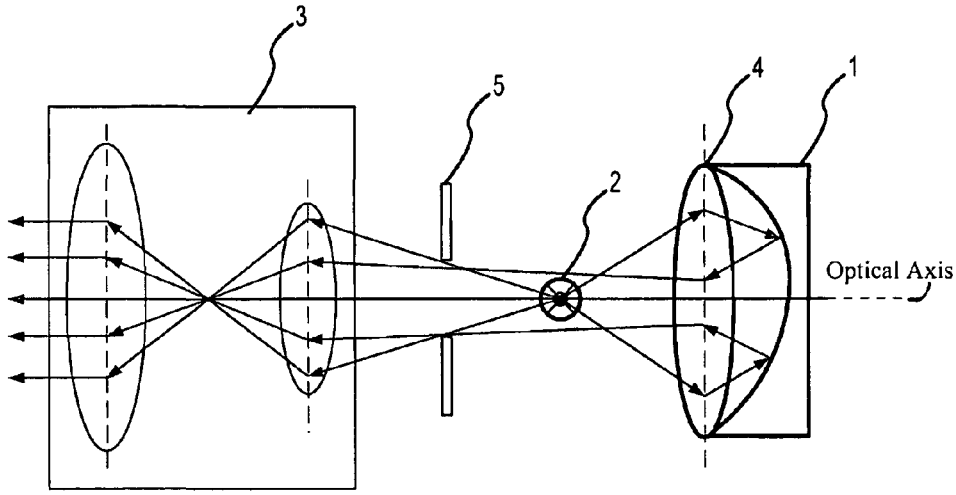
FIG. 1 shows a diagram of the light device with a single reflector and a single collecting pre-reflector lens.

One embodiment of a light device in accordance with the present invention is shown in FIG. 1. The illustrated device generally includes a main reflector 1 with a reflecting surface implemented as a segment of sphere; a point light source 2, e.g. an electric lamp or an arc candle; a lens projection system 3; a main collecting pre-reflector lens 4, which is biconvex and symmetrical in this example; and diaphragm 5. The main reflector and lens projection system 3 are located opposite each other and so that their optical axes coincide and the distance between them is at least about 1.5 the main reflector 1 focal distance. Point light source 2 is mounted between main reflector 1 and lens projection system 3. This point light source 2 is located on the main reflector 1 optical axis, and its location coincides with the main reflector's focal point. Main collecting pre-reflector lens 4 is mounted between light source 2 and main reflector 1, whose focal distance is about 1.25–2.0 times as big as the main reflector's focal distance. Main collecting pre-reflector lens 4 is mounted so that its optical axis coincides with the optical axis of main reflector 1, and its distance from main reflector 1 is about 0.5–0.25 of the main reflector 1 focal distance. Diaphragm 5 is mounted before lens projection system 3, whose hole diameter and distance to lens projection system 3 are chosen so as to minimize the level of luminous radiation from light source 2 that has not reached main reflector 1.

Figure 2:
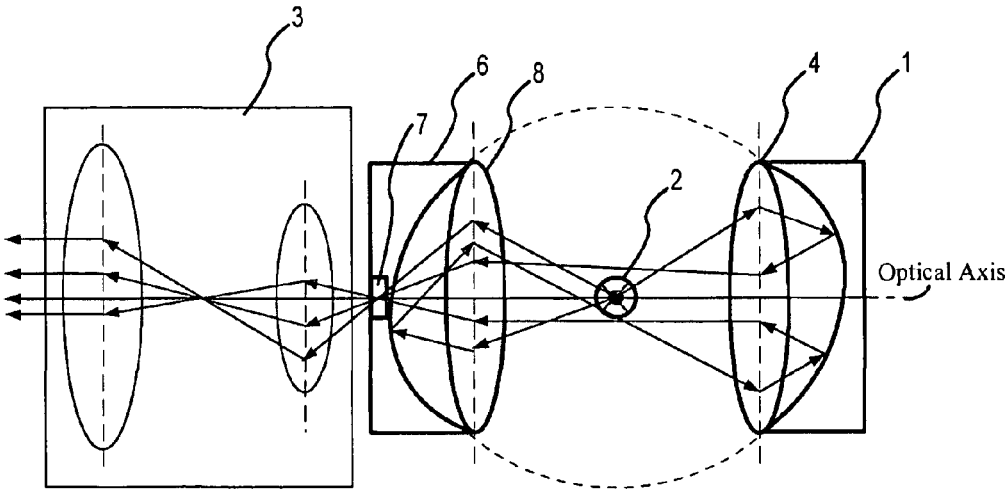
FIG. 2 shows a diagram of the light device with two reflectors and two collecting pre-reflector lenses.

In an alternative embodiment, an auxiliary reflector 6 can be mounted in this light device (see FIG. 2). This auxiliary reflector 6 has a reflecting surface identical to that of main reflector 1 i.e., its surface is shaped as a segment of sphere, and the focal distance is equal to that of main reflector 1. However, through hole 7 is cut auxiliary reflector 6, whose axis coincides with the optical axis of this auxiliary reflector 6. The auxiliary reflector 6 is located so that its optical axis coincides with the optical axis of main reflector 1 and its focal point coincides with the focal point of main reflector 1. An auxiliary collecting lens 8 is mounted between light source 2 and auxiliary reflector 6, whose focal length is about 1.25–2.0 times as big as the focal length of auxiliary reflector 6. The auxiliary collecting lens 8 is located so that its optical axis coincides with the optical axis of main reflector 1, and its distance from auxiliary reflector 6 does not exceed half of the distance auxiliary reflector 6 to light source 2. A lens projection system 3 is mounted before through hole 7 on the side that is on to that opposite which light source 2 is located. This lens projection system 3 is located so that its optical axis coincides with the optical axis of main reflector 1.

In the event that the device includes the main reflector alone, it functions as follows (see FIG. 1). Luminous radiation propagates from light source 2 in all directions in dissipated form. A part of dissipated luminous radiation immediately reaches lens projection system 3 where it is collimated in a narrow light beam, and this beam is transmitted into the illuminated space. Another part of this dissipated luminous radiation, which goes in a direction that is opposite to main lens projection system 3, first reaches main collecting pre-reflector lens 4. This main collecting pre-reflector lens 4 focuses the dissipated luminous radiation in a light spot on the reflecting surface of main reflector 1, whose diameter depends upon the distance between main collecting pre-reflector lens 4 and the reflecting surface of main reflector 1.

Main reflector 1 reflects the luminous radiation coming from this light spot, and shapes it as a focused light beam with the focal point located in or near the body of main collecting pre-reflector lens 4, since light source 2 is located in the focal point of main reflector 1 according to the design of this device. However, the luminous radiation from this light spot, reflected from main reflector 1, reaches main collecting pre-reflector lens 4 again. This main collecting pre-reflector lens 4 has a focal length exceeding that of main reflector 1 by a factor of 1.25–2.0 according to the design of this device. Therefore, main collecting pre-reflector lens 4 collects the luminous radiation coming from main reflector 1 in a low-divergent narrow light beam subsequently reaching lens projection system 3 where it is additionally collimated in a narrow substantially parallel light beam, and then directed into the illuminated space. Test results show that the intensity of this light beam is at least twice as high as the intensity of the light beam produced in the absence of main collecting pre-reflector lens 4, other light device parameters being identical. However, if diaphragm 5 is mounted in this device, it will cut off that part of luminous radiation that has not been collected by main reflector 1 with main collecting pre-reflector lens 4 and by auxiliary reflector 6 (FIG. 2) onto auxiliary collecting lens 8 where this luminous radiation is focused again, and then reaches main collecting pre-reflector lens 4. This main collecting pre-reflector lens 4 focuses the luminous radiation again, and collects it in a light spot on the surface of main reflector 1, whose diameter does not exceed the diameter of the light beam formed by same main collecting pre-reflector lens 4 during the passage of the luminous radiation coming directly from light source 2 through main collecting pre-reflector lens 4. Then the light beam formation process taking place during the reflection of luminous radiation coming from this light spot develops as described above. The luminous radiation reaching lens projection system 3 is a total of the luminous radiation coming from light source 2 directly to auxiliary collecting lens 8, the luminous radiation coming from light source 2 to main reflector 1 with main collecting pre-reflector lens 4, and the luminous radiation coming from light source 2 to auxiliary reflector 6 with auxiliary collecting lens B. All these radiation fluxes combine to a single flux of approximately equal diameter and divergence, and then are additionally formed in common lens projection system 3, so a light beam is formed at the output of this lens projection system 3 with an intensity equal to the total of the intensities of all of the light beams listed above and a low divergence. Test results show that the intensity of this light beam is at least 3–4 times as high as the intensity of the light beam obtained in certain known light devices with identical light characteristics of the light source.

What is claimed is:

1. A light device comprising:

a light source;

a concave reflector;

a lens projection system; and a collecting lens between said light source and said reflector, wherein said collecting lens is movable along an optical axis relative to said light source and said reflector;

said light source, reflector and lens system being substantially aligned relative to said optical axis such that a light beam emitting from said device is collimated into a substantially parallel light beam having a diameter less than the diameter of said reflector.

2. A light source as set forth in claim 1, wherein said collecting lens is a biconvex lens.

3. A light source as set forth in claim 1, wherein said light source is located substantially at a focal point of said reflector.

4. A light source as set forth in claim 1, wherein said collecting lens has a focal length that is between about 1.25 and about 2.0 times a focal length of said reflector.

5. A light source as set forth in claim 1, wherein said collecting lens is disposed a first distance from said source relative to said optical axis and said reflector is disposed a second distance from said source relative to said optical axis, where the first distance is at least one-half the second distance.

6. A light source as set forth in claim 1, wherein said reflector has a focal length and said collecting lens is disposed at a distance from said reflector relative to said optical axis, where the distance is between ¼ and ½ of the focal length of the reflector.

7. A light source as set forth in claim 1, where a diameter of said collecting lens is at least as great as a diameter of said reflector.

8. A light source as set forth in claim 1, further comprising a diaphragm disposed between said source and said lens projection system.

9. A light source as set forth in claim 8, wherein said diaphragm has an aperture dimensioned to minimize transmission of unreflected light along said optical axis towards said lens projection system, where said unreflected light is light transmitted directly from said source free from reflection by said reflector.

10. A light device comprising:

a light source;

a concave reflector;

a lens projection system;

said light source, reflector and lens system being substantially aligned relative to an optical axis; and a collecting lens between said light source and said reflector, wherein said collecting lens is movable along said optical axis relative to said light source and said reflector.

11. A light source as set forth in claim 10, wherein said collecting lens is a biconvex lens.

12. A light source as set forth in claim 10, wherein said reflector has a focal length and said lens projection system and said reflector are separated by a distance that is at least 1.5 times the focal length.

13. A light source as set forth in claim 10, wherein said collecting lens has a first focal length and said reflector has a second focal length where the second focal length is between 1.25 and 2.0 time the first focal length.

14. A light source as set forth in claim 10, wherein said collecting lens is disposed a first distance from said source relative to said optical axis and said reflector is disposed a second distance from said source relative to said optical axis, where the first distance is at least ½ of the second distance.

15. A light source as set forth in claim 10, wherein said reflector has a focal length and said collecting lens is disposed at a distance from said reflector relative to said optical axis, where the distance is between ¼ and ½ of the focal length of the reflector.

16. A light device comprising:

a light source;

a concave reflector;

a lens projection system;

said light source, reflector and lens system being substantially aligned relative to an optical axis; and a collecting lens between said light source and said reflector, wherein said collecting lens is disposed a first distanced from said source relative to said optical axis and said reflector is disposed a second distance from said source relative to said optical axis, where the first distance is at least ½ of the second distance.

17. A light source as set forth in claim 16, wherein said collecting lens has a first focal length and said reflector has a second focal length, where the first focal length is between 1.25 and 2.0 times the second focal length.

18. A light source as set forth in claim 16, wherein said reflector has a focal length, and said lens projection system and said reflector are separated by a distance of at least 1.5 times the focal length of the reflector.

19. A light source as set forth in claim 16, wherein said reflector has a focal length, and said collecting lens is disposed at said distance from said reflector relative to said optical axis, where the distance is between ¼ and ½ if the focal length of the reflector.

20. A light device comprising:

a light source;

a concave reflector having a focal length;

a lens projection system;

said light source, reflector and lens system being substantially aligned relative to an optical axis; and a collecting lens disposed at a distance from said reflector relative to said optical axis, where the distance is between ¼ and ½ of the focal length of the reflector, and wherein said collecting lens is disposed between said light source and said reflector.

21. A light source as set forth in claim 20, wherein said lens projection system and said reflector are separated by a distance of at least 1.5 times the focal length of the reflector.

22. A light source as set forth in claim 20, wherein said collecting lens has a focal length that is between 1.25 and 2.0 times the focal length of the reflector.

23. A light source as set forth in claim 20, wherein said collecting lens is disposed a first distanced from said source relative to said optical axis and said reflector is disposed a second distance from said source relative to said optical axis, the first distance is at least ½ of the second distance.

24. A light device comprising:

a light source;

a concave reflector having a first focal length;

a lens projection system;

said light source, reflector and lens system being substantially aligned relative to an optical axis; and a collecting lens between said light source and said reflector, said collecting lens having a second focal length that is between about 1.25 and about 2.0 times the first focal length of said reflector.

25. A light source as set forth in claim 24, wherein said lens projection system and said reflector are separated by a distance that is at lest 1.5 times the first focal length.

26. A light source as set forth in claim 24, wherein said light source is located substantially at a focal point of said reflector.

27. A light source as set forth in claim 24, wherein said collecting lens is disposed a first distance from said source relative to said optical axis and said reflector is disposed a second distance from said source relative to said optical axis, where the first distance is at least ½ of the second distance.

28. A light source as set forth in claim 24, wherein said collecting lens is disposed at a distance from said reflector relative to said optical axis, where the distance is between ¼ and ½ of the first focal length.

* * * * *